US009506440B2

(12) United States Patent
Lachaize

(10) Patent No.: US 9,506,440 B2
(45) Date of Patent: Nov. 29, 2016

(54) ADAPTIVE FUEL DIRECT INJECTION SYSTEM

(75) Inventor: Jérôme Lachaize, Toulouse (FR)

(73) Assignees: CONTINENTAL AUTOMOTIVE FRANCE, Toulouse (FR); CONTINENTAL AUTOMOTIVE GMBH, Hannover (DE)

( * ) Notice: Subject to any disclaimer, the term of this patent is extended or adjusted under 35 U.S.C. 154(b) by 294 days.

(21) Appl. No.: 14/118,694

(22) PCT Filed: Apr. 17, 2012

(86) PCT No.: PCT/EP2012/001649

§ 371 (c)(1),
(2), (4) Date: Jan. 8, 2014

(87) PCT Pub. No.: WO2012/159693

PCT Pub. Date: Nov. 29, 2012

(65) Prior Publication Data

US 2014/0109875 A1 Apr. 24, 2014

(30) Foreign Application Priority Data

May 20, 2011 (FR) ..... 11 01558

(51) Int. Cl.
*F02M 57/02* (2006.01)
*F02M 63/02* (2006.01)
(Continued)

(52) U.S. Cl.
CPC ..... *F02M 63/0225* (2013.01); *F02D 41/20* (2013.01); *F02D 41/3845* (2013.01); *F02D 41/2464* (2013.01)

(58) Field of Classification Search
CPC ..... F02M 63/0225; F02D 41/3845; F02D 41/20; F02D 41/2464
USPC ..... 123/446, 447; 701/102–105
See application file for complete search history.

(56) References Cited

U.S. PATENT DOCUMENTS 5,328,100 A 7/1994 Bergstrom et al.
6,119,655 A * 9/2000 Heinitz ..... F02D 41/20 123/447

(Continued)

FOREIGN PATENT DOCUMENTS

CN 1090909 8/1994
DE 10 2007 020969 A1 11/2008

(Continued)

OTHER PUBLICATIONS

International Search Report, dated Jun. 1, 2012, from corresponding PCT application.

*Primary Examiner* — Thomas Moulis
*Assistant Examiner* — Joseph Dallo
(74) *Attorney, Agent, or Firm* — Young & Thompson

(57) ABSTRACT

A direct fuel injection system including a common rail and control unit, a pump, an on/off valve, controlled by the control unit, to regulate the volume of fuel sent to the pump to be fed into the common rail, the control unit including: first determination elements for determining a peak phase duration during which a command must be applied to the valve to obtain a peak current to cause a change of state of the valve; second determination elements for determining a holding ratio according to which a command must be applied to the valve, after its change of state, to maintain a holding current necessary to maintain the state of the valve; application elements for applying the command to the valve first continuously during the peak phase duration and then by pulse width modulation according to the holding ratio; and at least one recurrent and automatic adaptation element.

10 Claims, 6 Drawing Sheets

(51) Int. Cl.

| | |
|---|---|
| ***F02D 41/20*** | (2006.01) |
| ***F02D 41/38*** | (2006.01) |
| *F02D 41/24* | (2006.01) |

(56) References Cited

U.S. PATENT DOCUMENTS

| | | | | |
|---|---|---|---|---|
| 7,370,635 | B2 * | 5/2008 | Snopko | F02D 41/221 123/198 D |
| 7,389,767 | B2 * | 6/2008 | Kasbauer | F02D 41/123 123/333 |
| 7,392,790 | B2 * | 7/2008 | Shafer | F02D 41/22 123/198 D |
| 7,431,018 | B2 * | 10/2008 | Tsujimoto | F02D 41/221 123/446 |
| 7,503,313 | B2 * | 3/2009 | Achleitner | F02D 41/3082 123/446 |
| 7,543,566 | B2 * | 6/2009 | Holl | F02D 41/2464 123/446 |
| 7,606,656 | B2 * | 10/2009 | Dolker | F02D 41/3854 123/456 |
| 7,779,815 | B2 * | 8/2010 | Ricco | F02D 41/3845 123/446 |
| 8,240,290 | B2 * | 8/2012 | Miyake | F02D 41/3836 123/198 D |
| 2003/0121501 | A1 * | 7/2003 | Barnes | F02D 41/2422 123/446 |
| 2004/0055576 | A1 * | 3/2004 | McCarthy, Jr. | F02D 41/0087 123/458 |
| 2005/0279867 | A1 * | 12/2005 | Ismailov | F02D 41/20 239/585.1 |
| 2006/0090735 | A1 * | 5/2006 | La Rosa | F02D 41/2429 123/446 |
| 2006/0130813 | A1 * | 6/2006 | Dolker | F02D 41/3854 123/458 |
| 2006/0201488 | A1 | 9/2006 | Kohler et al. | |
| 2008/0059039 | A1 * | 3/2008 | Nakagawa | F02D 41/3863 701/99 |
| 2009/0064971 | A1 * | 3/2009 | Ricco | F02D 41/3845 123/446 |
| 2009/0183714 | A1 * | 7/2009 | Mayuzumi | F02D 41/20 123/490 |
| 2009/0326788 | A1 * | 12/2009 | Yuasa | F02D 41/3809 701/104 |
| 2010/0193036 | A1 * | 8/2010 | Haggenmiller | F02D 41/20 137/1 |
| 2010/0237266 | A1 | 9/2010 | Haaf et al. | |
| 2011/0295493 | A1 | 12/2011 | Wilms et al. | |

FOREIGN PATENT DOCUMENTS

| | | | |
|---|---|---|---|
| DE | 10 2007 035316 | A1 | 1/2009 |
| DE | 10 2008 054 513 | A1 | 6/2010 |
| EP | 1 122 424 | B1 | 8/2001 |
| JP | 2002 237411 | A | 8/2002 |
| WO | 2006-060545 | | 6/2006 |

* cited by examiner

Fig 8
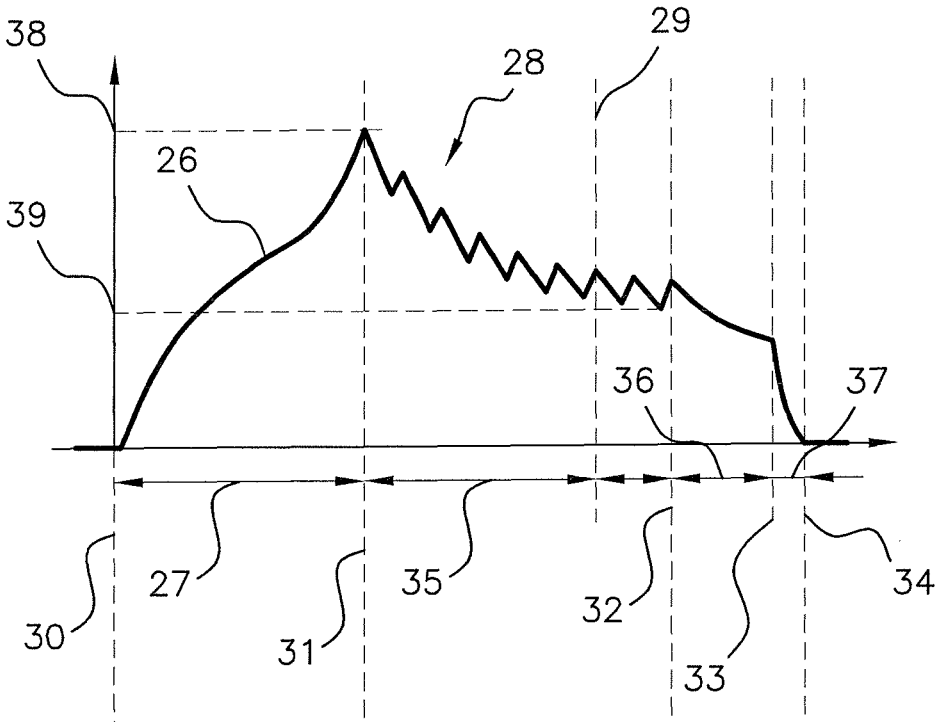
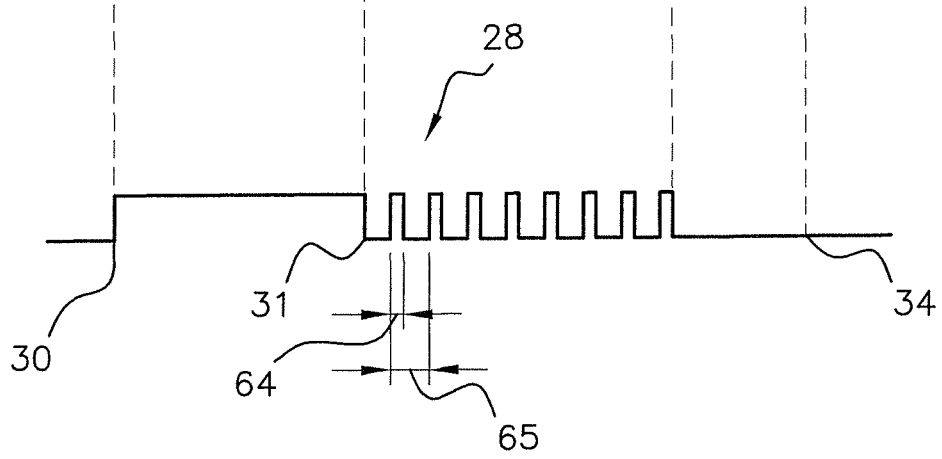
Fig 9

ADAPTIVE FUEL DIRECT INJECTION SYSTEM

The present invention concerns a common rail fuel direct injection system, of the type useable for an internal combustion engine.

BACKGROUND OF THE INVENTION

As is described in more detail hereinafter, a fuel valve is controlled by means of two variables: on the one hand a "peak duration" first variable which conditions a "peak current" first objective variable and on the other hand a "holding ratio" second variable which conditions a "holding current" second objective variable at the end of the holding phase.

The problem is that the relationship between a variable and the associated objective variable depends on numerous mechanical or electrical parameters that vary from one vehicle to another and can moreover vary as a function of temperature and/or time.

Direct open loop control therefore runs the risk of calculating a variable value that is too low with the risk of not producing the necessary objective variable. Thus if a peak current is too low there is a risk of the valve not opening or closing. On the other hand, if the peak current is too high, this leads to unnecessary wear of the valve.

In order to remedy these harmful differences and variations, the use of a servocontrol system may be envisaged, for example employing current regulation. The use of such a control system is very costly, however.

A low-cost solution is therefore looked for that makes it possible to circumvent these parameter differences and variations.

SUMMARY OF THE INVENTION

The invention consists in a direct fuel injection system including a common rail including a control unit, a pump and a valve, controlled on an on or off basis by the control unit, in order to regulate the volume of fuel sent to the pump to be fed into the common rail, said control unit comprising

- first determination means adapted to determine a first variable (a peak phase duration) during which a command must be applied to the valve in order to obtain a first objective variable (a peak current) greater than or equal to a reference value (a reference peak current), necessary to cause a change of state of the valve,
- second determination means adapted to determine a second variable (a holding ratio) according to which a command must be applied to the valve, after its change of state, in order to maintain a second objective variable (a holding current) greater than or equal to a reference value (a reference holding current) necessary to maintain said state of the valve,
- application means adapted to apply said command to said valve first continuously during said peak phase duration and then by pulse width modulation in accordance with said holding ratio.

The system is noteworthy in that adaptation means are provided for the first variable and/or the second variable, these adaptation means being recurrent and automatic for said variable.

According to another feature of the invention, said adaptation means are adapted to calculate a coefficient of modulation and to apply it as a multiplier to the variable in order to correct it.

According to another feature of the invention, said adaptation means further include calculation means adapted to calculate said coefficient of modulation recurrently as a function of its preceding value and the difference between the objective variable and its reference value.

According to another feature of the invention, said calculation means are adapted to apply the formula:

$$CM(n) = CM(n-1) + G \cdot \frac{Vref(n) - V(n)}{Vref(n)}$$

in which

CM(n) is the coefficient of modulation at the time n,

CM(n−1) is the coefficient of modulation at the preceding time n−1,

G is a gain,

V(n) is the objective variable at the time n,

Vref(n) is the reference value of the objective variable V at the time n.

According to another feature of the invention, the calculation means are adapted to recalculate the coefficient of modulation periodically.

According to another feature of the invention, the calculation means are adapted to recalculate the coefficient of modulation if the variable leaves a predetermined range.

BRIEF DESCRIPTION OF THE DRAWINGS

Other features, details and advantages of the invention will emerge more clearly from the detailed description given hereinafter by way of illustration and with reference to the drawings, in which:

FIG. 8 shows the current curve in detail, FIG. 9 shows the command curve in detail.

DETAILED DESCRIPTION OF THE PREFERRED EMBODIMENTS

Figure 1:
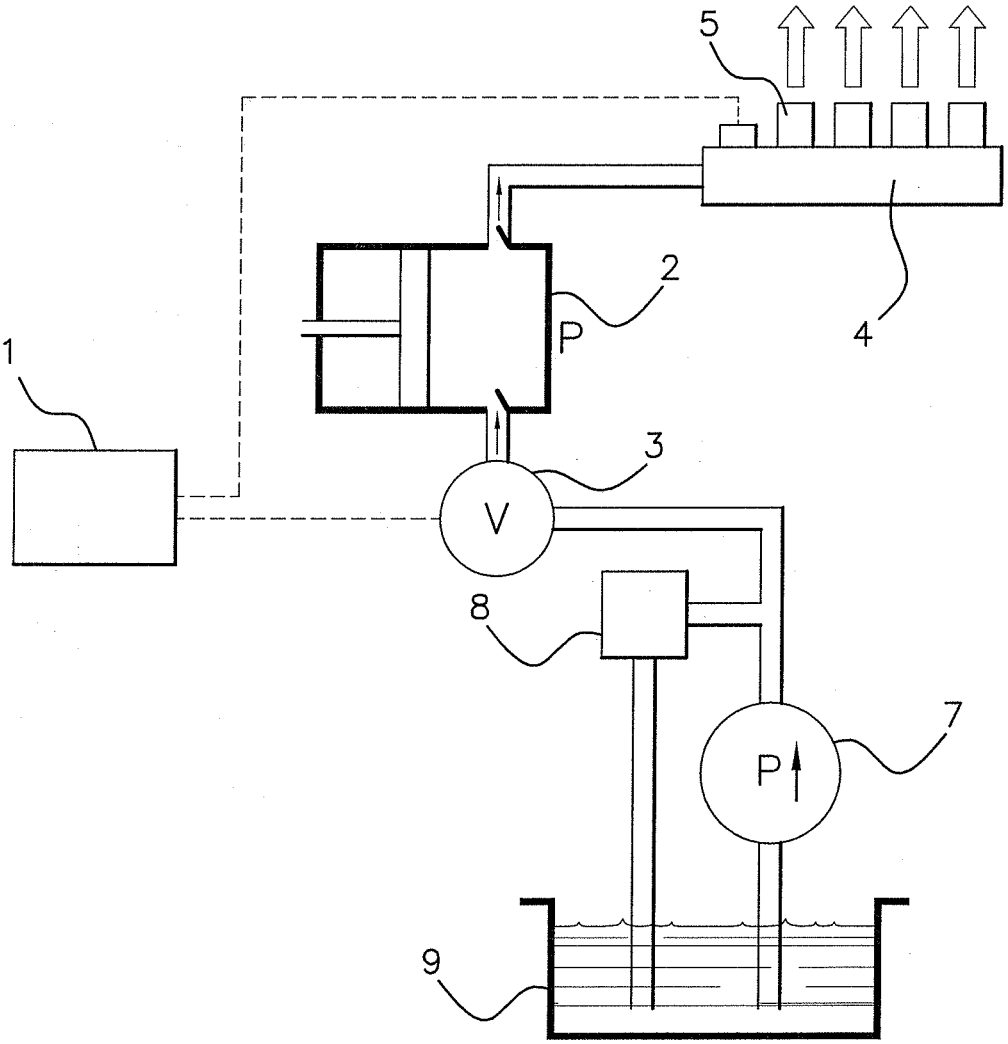
FIG. 1 is a general schematic of a system in accordance with the invention in situ.

FIG. 1 shows an injection system for feeding fuel to a common rail 4. Said common rail 4 is provided with injectors 5, of which there are four here, enabling it to inject fuel into the cylinders of an engine (not represented).

In FIG. 1, the connections in solid line represent fuel pipes and electrical connections are shown in dashed line.

A low-pressure fuel feed device conventionally comprises a fuel tank 9 and a low-pressure pump 7 which in combination with a pressure regulator 8 feeds a high-pressure circuit with fuel.

This high-pressure circuit includes a high-pressure pump 2 and a valve 3 which controls the quantity of fuel that the high-pressure pump 2 sends to the common rail 4. The valve 3 is controlled by a control unit 1 on an on or off basis and is either open or closed.

FIGS. 2-5 show one embodiment of a detail of the injection system featuring a high-pressure pump 2 and a valve 3 integrated into a distribution unit 17. The high-pressure pump 2 is of the type with a single piston 10. This piston 10 is driven by a cam 11 fixed to a camshaft. The camshaft is driven by the engine at a rotation frequency n times the rotation frequency of the crankshaft of the engine, with n between 2 and 4. The control unit 1 observes the angular position of the cam 11 in order to synchronize the commands sent to the valve 3 with the cycle of the pump 2. The valve 3 includes a mobile valve member 12 driven via drive means 13, here an electrically controlled electromagnet, by the control unit 1. Said valve member is urged into a default open position here, by return means 14. The distribution unit 17 further includes an inlet pipe 15 connected to the low-pressure fuel feed device and an outlet pipe 16 connected to the common rail 4. The valve member 12 of the valve 3 is disposed on the inlet pipe 15 between the feed 7 and the pump 2. A second valve member 18, the default position of which is closed, and which is not controllable but is returned by return means 19 is disposed on the outlet pipe 16 between the pump 2 and the common rail 4.

Figure 2:
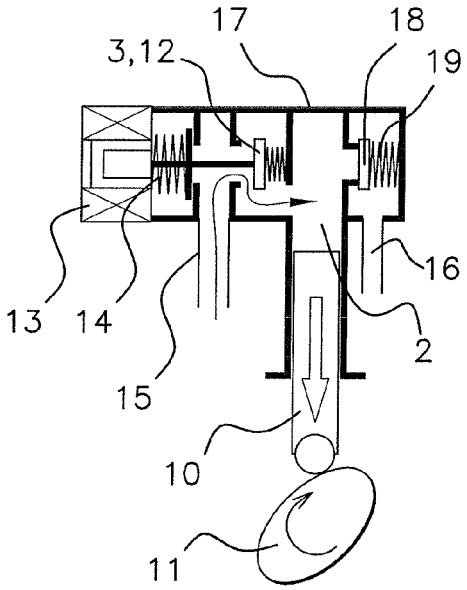
FIGS. 2-5 show respective phases in the operation of the pump and valve device.

FIG. 2 shows a first phase I. During this phase I the piston 10 descends/aspirates. The valve 3 is not commanded and the first valve member 12 is in the open position. The second valve member 18 is in the closed position. As a result fuel is aspirated into the pump 2 via the inlet pipe 15.

Figure 3:
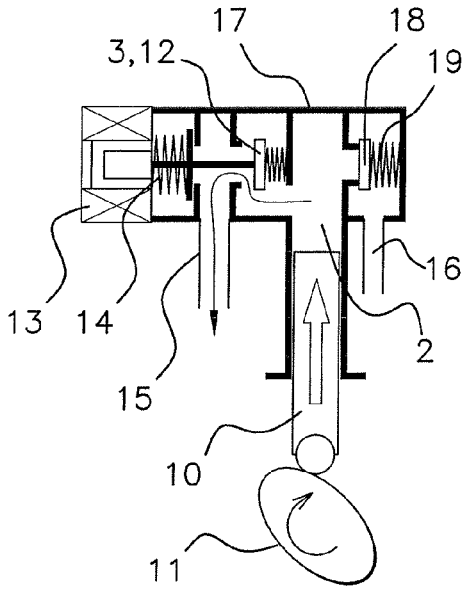

FIG. 3 shows a phase II. In this phase the piston 10 has passed its bottom dead center (BDC) position and is rising, discharging fuel. The valve 3 is still open and the second valve member 18 is still in the closed position. As a result fuel is discharged to the inlet pipe 15.

Figure 4:
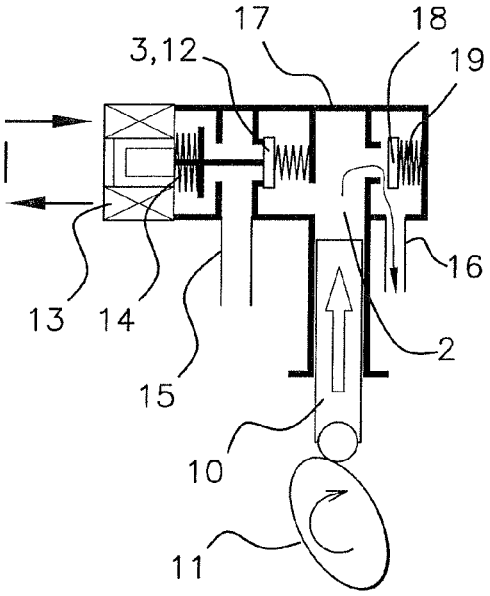

FIG. 4 shows a phase III. In this phase the piston 10 continues to rise. The valve 3 is commanded and has changed state. It is now closed and the first valve member 12 shuts off the inlet pipe 15. Because of the effect of the rising of the piston 10, the discharge pressure increases until it exceeds the return force of the return means 19 of the second valve member 18, which opens. As a result fuel is sent via the outlet pipe 16 to the common rail 4.

Figure 5:
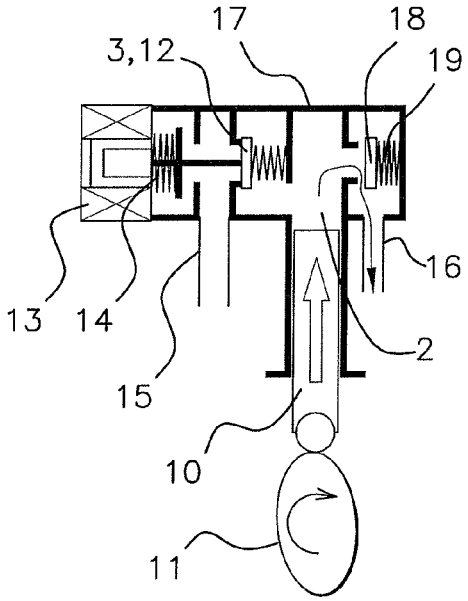

FIG. 5 shows a phase IV. In this phase the piston 10 continues to rise and a pressure prevails in the pump 2. The valve 3 is no longer commanded. However, because the action of the pressure is higher than the return force of the return means 14 of the first valve member 12, it remains closed, the first valve member 12 shutting off the inlet pipe 15.

Continuing its travel, the piston 10 reaches its top dead center (TDC) position and returns to phase I. Having passed the top dead center position, the piston begins to descend/aspirate. The pressure falls in the pump 2 and enables the return means 19 to close the second valve member 18. This ends the discharging of fuel to the common rail 4. The valve 3 no longer being commanded, the drop in pressure also releases the first valve member 12, which can be opened by the effect of the reduced pressure.

Figures 6, 7:
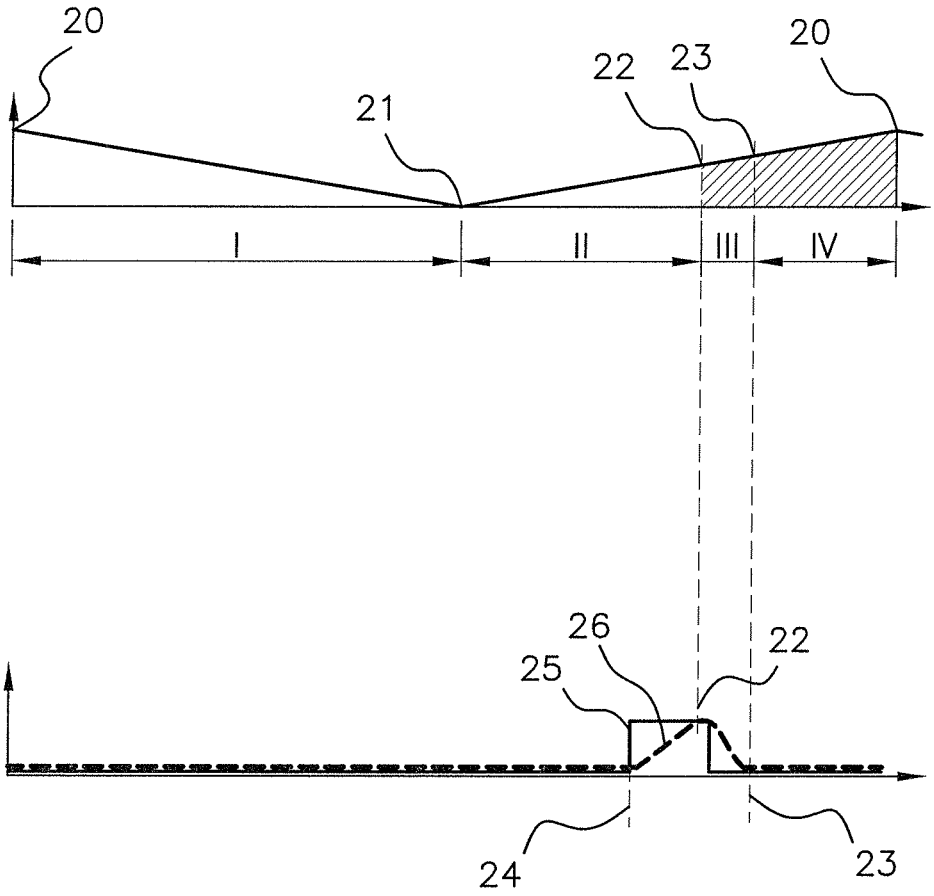
FIG. 6 shows these phases in relation to the position of the cam.
FIG. 7 represents the command and current curves in relation to the position of the cam.

FIG. 6 shows a curve plotting on the ordinate axis the travel of the piston 10 of the pump 2 as a function of time plotted on the abscissa axis or (which amounts to the same thing) as a function of the angle of the cam 11, over a complete cycle of the cam 11. The above phases I-IV are indicated. The cycle and phase I begin at a top dead center position 20 of the piston 10. In the middle of the cycle, at a bottom dead center (BDC) position 21, phase I ends and phase II begins. Phase II ends and phase III begins at the time 22 at which the valve 3 changes state (closes in the examples shown). The injection device operates from this time 22 and injects fuel into the common rail 4. Phase III ends at the time 23 at which the valve 3 ceases to be commanded, at which time phase IV begins. Because a pressure is present, the valve 3 remains in the same state and the injection device continues to operate until the end of phase IV, which coincides with a new top dead center position 20.

The function of the system according to the invention is to control the volume of fuel fed into the common rail 4. This volume is a direct function of the time for which the injection device operates (for which the valve 3 is closed). This time, shown cross-hatched in the FIG. 6 curve, begins at the beginning of phase III and ends at the end of phase IV at the top dead center position 20.

Because the end time, situated at the top dead center position 20, is predetermined by the cam angle and therefore not controllable by the control unit 1, the control unit 1 must control precisely the start time 22 of phase III, at which the valve 3 changes state, in order to control the time for which the device operates and thus to control the volume of fuel injected.

FIG. 7, in alignment with the FIG. 6 curve and with the same scale of time/cam angle plotted on the abscissa axis, shows the control of the valve 3. To obtain a change of state of the valve 3, here closing, it is necessary to apply a command to the terminals of the drive means 13 of the valve 3. The drive means 13 are typically an electromagnet and the command is a voltage applied to the terminals of its coil. The application of a voltage command in accordance with the curve 25 produces a current in accordance with the curve 26 at the terminals of the drive means 13. Said current increases as a function of a time of application 27 of the voltage 25 (cf. FIG. 8).

In order to obtain a current 38 sufficient to bring about a change of state of the valve 3 at the time 22, it is necessary to determine accurately a time of application 27 of a command or a peak phase duration 27. It is then necessary to anticipate the application of the voltage command relative to the determined time of change of state of the valve 3, to start application of the command at a time 24 preceding the time 22 said peak phase duration 27.

The current curve 26 is shown in detail in FIG. 8. From left to right, the current curve 26 begins at the value 0 at the initial time 30, 24 at which application of the voltage command begins. The objective being to obtain a peak current 38 as quickly as possible, this command is applied continuously. There follows an increasing phase called the peak phase. Following a time 27 of application of the command or peak phase duration Tp, the current reaches a maximum value 38 or peak current IM at the time 31.

To obtain a particular volume of fuel, it is desirable for the time 31 at which the peak phase ends to coincide with the time 22 at which the valve 3 must change state. To this end it is necessary to anticipate said time 22, 31 by the peak phase duration 27 in order to determine the time 30, 24 to begin application of the command.

Moreover, to effect said change of state of the valve 3, it is necessary to achieve at the end 31 of the peak phase a peak current IM, 38 at least equal to a reference peak current IMref sufficient to produce said change of state. This reference peak current IMref is supplied by the manufacturer of the valve 3.

The peak current IM, 38 reached at the end of the peak phase depends directly on the time of application of the command 27, which is the duration 27, Tp of the peak phase.

The peak phase duration 27, Tp is a first variable. Its value is calculated by the control unit 1 and directly determines the value of the peak current 38, IM, which is a first objective variable.

After the valve 3 has changed state, to maintain this new state it is necessary to retain a minimum holding current 39, Im between the terminals of the drive means 13, at least during a holding phase of duration 35. Pulse width modulation (PWM) voltage control advantageously makes it possible, in the known manner, to vary the current obtained. This minimum holding current 39, Im must be at least equal to a reference holding current Imref at the end of the holding phase. It is not desirable for this current to exceed by much the reference holding current value Imref because the current passing through the drive means 13 must return to zero before the next cycle.

This reference holding current Imref is supplied by the manufacturer of the valve 3 and is less than the reference peak current IMref.

For example, one valve that has been used has a reference peak current IMref of 7 A and a reference holding current Imref of 2.5 A.

The holding current 39, Im is produced using PWM control with a holding ratio 28, R. This pulse width modulation control is applied during a holding time 35 of a holding phase beginning at the time 31 and ending at the time 32.

The holding phase is followed by a "freewheel" phase between the time 32 and the time 33 and of duration 36, itself followed by a final phase between the time 33 and the time 34 and of duration 37. These freewheel and final phases differ in terms of their mode of application, but their function is to enable the current to return to zero before the beginning of the next cycle. The final phase end time 34 must be reached at the latest at the top dead center position 20. Minimum durations 36 and 37 must be provided to enable the freewheel and final phases.

At the end of the holding phase, at the time 23, 32, the valve 3 is no longer commanded. However, the valve 3 remains closed because of the action of the discharge pressure exerted by the piston 10 on the valve member 12, provided that a time/cam angle 29 is exceeded.

These two constraints enable the control unit 1 to determine the duration 35 of the holding phase. The duration 35 of the holding phase must be relatively long so as to end after the limit time 29. It must also be relatively short to provide the minimum durations 36 and 37 for the freewheel and final phases before the top dead center position 20 is reached, to enable the current to be cancelled out.

If the time 31 at which the admission of fuel begins is very early in the cycle, at the earliest at the BDC position 21, the duration 35 of the holding phase must be extended to reach at least the limit time 29. On the other hand, if the time 31 at which the admission of fuel begins is late in the cycle, the duration 35 must be shortened to provide minimum durations 36 and 37.

As a function of said holding time 35, the control unit 1 determines a holding ratio 28, R in accordance with which pulse width modulation voltage control must be applied in order to reach a holding current 39, Im at the earliest at the holding phase end time 32.

The holding ratio 28, R is a second variable. Its value is calculated by the control unit 1 and determines directly the value of the holding current 39, Im, which is a second objective variable.

The two variables consisting of the peak phase time 27 and the holding ratio 28 must be determined accurately in order to control accurately the two objective variables consisting of the peak current 38 and the holding current 39.

FIG. 9, in alignment with the FIG. 8 curve and with the same scale of time/cam angle plotted on the abscissa axis, shows the control of the valve 3.

From the time 30 to the time 31, during the peak phase, the command is applied continuously (here represented by a high state). During the holding phase, from the time 31 to the time 32, pulse width modulation control is applied in accordance with a holding ratio R, 28 and by means of periodic pulses. The width of a pulse 64 over a period 65 is determined by the holding ratio R, 28, according to the formula R=L/T, where L is the width 64 of a pulse and T is the width 65 of a period.

During the freewheel phase and the final phase, from the time 32 to the time 34, the command is not applied (low state).

The problem that arises is that the relationship between a variable and an associated objective variable depends on numerous mechanical or electrical parameters, such as the resistance and the inductance of the drive means 13 of the valve 3, the length and the section of the various cables, friction, etc. All these parameters vary from one injection system to another and can moreover vary as a function of temperature and/or time.

Because of these differences and variations, direct open loop control runs the risk of calculating a variable value that is too low or too high with the risk of not achieving the required objective variable. Thus if a peak phase duration 27, Tp is too short, there is a risk of the peak current 38, IM reached being less than the reference peak current value IMref and of the valve 3 not changing state. On the other hand, if the peak phase duration 27, Tp is too long, the peak current 38, IM is higher than the value necessary to bring about the change of state, with no technical advantage but with increased wear effects. Likewise if the holding ratio 28, R is too low, there is a risk of the holding current 39, Im reached being less than the reference holding current value Imref and of the state of the valve 3 not being maintained. On the other hand, if the holding ratio 28, Rp is too high, the holding current 39, Im is higher than the value necessary to achieve maintenance. This is harmful because the cancelling out of said current before the next cycle will be difficult to achieve and will typically be accompanied by greater generation of heat.

In order to eliminate these drawbacks and to circumvent the parameter differences and variations, in accordance with an advantageous feature of the invention, the injection system further includes adaptation means 42, 72 for the first variable consisting of the peak phase duration 27 and/or for the second variable consisting of the holding ratio 28. These adaptation means 42, 72 operate recurrently and automatically.

The adaptation of one of the two variables 27, 28 is totally independent of the adaptation of the other one. Each of said adaptation means 42, 72 may be envisaged independently of the other one. In a preferred embodiment, two adaptation means 42, 72 are used, each effecting the adaptation of one variable 27, 28.

The two adaptation means 42, 72 being formally identical, the description given is generic.

Figure 10:
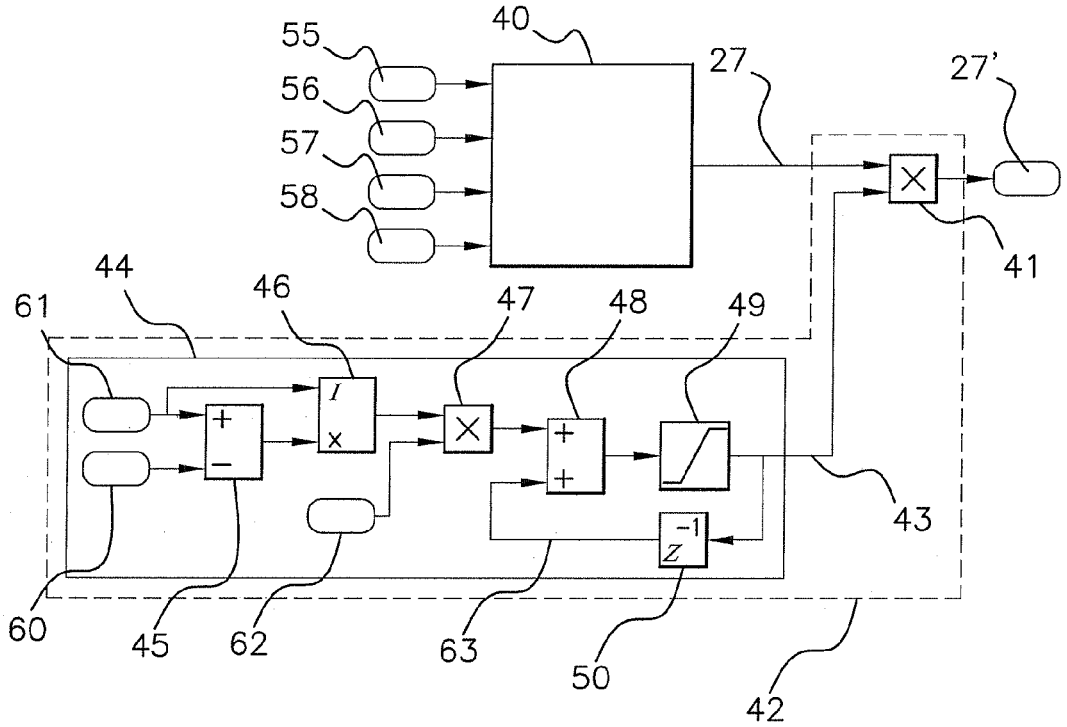
FIGS. 10 and 11 show the adaptation means.
Figure 11:
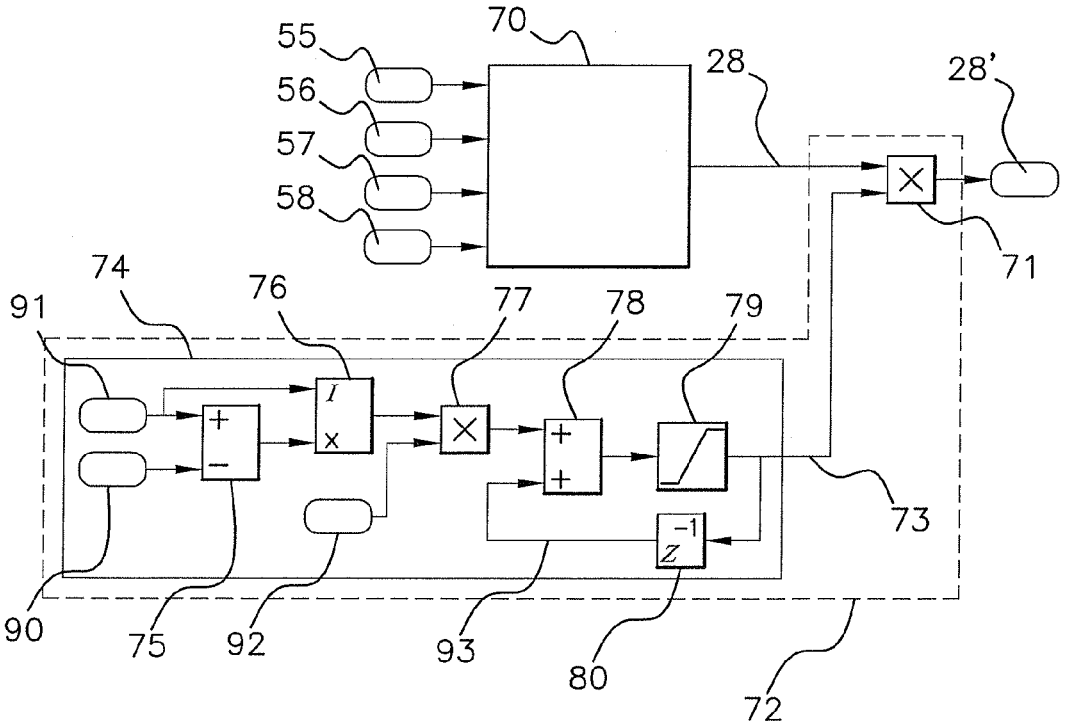

FIGS. 10, 11 show a system with respective adaptation means 42, 72 for the first variable consisting of the peak phase 27 and for the second variable consisting of the holding ratio 28.

The control unit 1 includes determination means 40, 70 that determine the variable 27, 28. The means 40 determine the peak phase duration 27 (first variable). This is determined as a function of the inputs to the means 40, which include, for example: the engine speed 55, the volume of fuel 56, the temperature 57 of the pump 2 and the battery voltage 58. This determination process is identical to the known process employed in existing open loop systems and does not constitute the subject matter of the invention.

The means 70 determine the holding ratio 28 (second variable). This is determined as a function of the inputs to the means 70, which include, for example: the engine speed 55, the volume of fuel 56, the temperature of the pump 2 and the battery voltage 58. This determination process is identical to the known process employed in existing open loop systems and does not constitute the subject matter of the invention.

The output variable 27', 28' of the device is used by command application means to drive the valve 3. Outside of the invention, the output variable 27', respectively 28' is equal to the variable 27, respectively 28 coming from the determination means 40, respectively 70.

The application of a command during the peak phase duration 27' (first variable) results in a peak current IM, 38 (first objective variable). The application of a command in accordance with the holding ratio 28' (second variable) results in a holding current Im, 39 (second objective variable).

In accordance with the invention, the control unit 1 further includes adaptation means 42, 72 in addition to the determination means 40, 70. These adaptation means 42, 72 include a mixer 41, 71 and calculation means 44, 74 and are adapted to adapt the variable 27, 28 coming from the determination means 40, 70 in order to produce an adapted variable 27', 28'.

In accordance with one embodiment, the calculation means 44, 74 of the adaptation means 42, 72 calculate a coefficient of modulation 43, 73. The mixer 41, 71 is then a multiplier. The output variable 27', 28' is equal to the variable 27, 28 coming from the determination means 40, 70 multiplied by the coefficient of modulation 43, 73. Said coefficient of modulation 43, 73 is stored and updated by the calculation means 44, 74 of the adaptation means 42, 72.

In accordance with one embodiment, the coefficient of modulation 43, 73 is calculated by recurrence as a function of its preceding value and a difference between the objective variable 60, 90 actually achieved and the reference value 61, 91 of the objective variable. The recurrence formula used is advantageously convergent. Thus the calculation means 44, 74 modify the coefficient of modulation 43, 73, which enables modification of the variable 27, 28, which modifies the objective variable 60, 90 so that and until the difference cancels out and the value of the objective variable 60, 90 is substantially equal to the reference value 61, 91 of the objective variable.

In accordance with one embodiment, the coefficient of modulation 43, 73 is calculated by means of the formula:

$$CM(n) = CM(n-1) + G \cdot \frac{Vref(n) - V(n)}{Vref(n)}$$

in which CM(n) is the coefficient of modulation 43, 73 at the current time n, CM(n−1) is the coefficient of modulation 63, 93 at the preceding time n−1, G is a gain 62, 92, V(n) is the objective variable 60, 90 at the time n, i.e. IM, 38, respectively Im, 39, and Vref(n) is the reference value 61, 91 of the objective variable V at the time n, i.e. IMref, respectively Imref.

The recurrence formula may be started with any value of CM(0), for example equal to 1.

The gain G, 62, 92 is determined so that the formula converges (substantially zero difference) in a few iterations. For example, this can be done by trial and error, on a prototype, or by simulation.

This formula may be implemented as shown in FIGS. 10 and 11. A first adder 45, 75 determines the difference between the measured value 60, 90 of the objective variable and the reference value 61, 91 of the objective variable. A first multiplier 46, 76 divides this difference by the reference value 61, 91. A second multiplier 47, 77 multiplies the preceding result by a gain G, 62, 92. A second adder 48, 78 adds to the result the coefficient of modulation CM(n−1), 63, 93 at the preceding time n−1 stored by a delay unit 50, 80.

The result is then saturated by a saturator 49, 79. The result is a new coefficient of modulation CM(n), 43, 73. This saturator 49, 79 is optional. It enables a tolerance to be defined over the range of variation and excessive drift of the coefficient of modulation CM(n) to be avoided. It may also be used to detect any such drift. With well-chosen saturation limits, it is possible, when the saturator 49, 79 is actuated, to deduce therefrom a drift of the device of an amplitude greater than that which can be caused by the differences and variations that it is required to correct. This is indicative of an alarm situation signaling a fault.

The coefficient of modulation CM, 43, 73 can be calculated periodically by the calculation means 44, 74. The difference therefore remains substantially zero and the system is able to supply a peak duration Tp, 27, respectively a holding ratio R, 28, that guarantees a peak current IM, 38, respectively a holding current Im, 39, close to its reference value IMref, respectively Imref, circumventing the parameter differences right away from the first recurrences and correcting in an adaptive manner any variation of at least one of the parameters over time.

Two types of phenomena may lead to having to employ adaptation. On the one hand, differences in the tolerances of the components, which appear initially. The consequences of these differences are corrected by adaptation, in a few recurrences, during the first cycles of operation. On the other hand, variations of the parameter that occur over time. These variations, linked to wear, feature relatively slow time constants. Consequently, the adaptation calculation frequency does not need to be very high.

In accordance with one embodiment, as an alternative to periodic recalculation, the calculation means 44, 74 may observe the difference between the measured value 60, 90 and the reference value 61, 91 and trigger a new adaptation calculation only if this difference departs from a given range. The upper and lower limits of this range are determined as a function of the tolerances on the reference values IMref and Imref supplied by the manufacturer of the valve 3.

Figure 12:
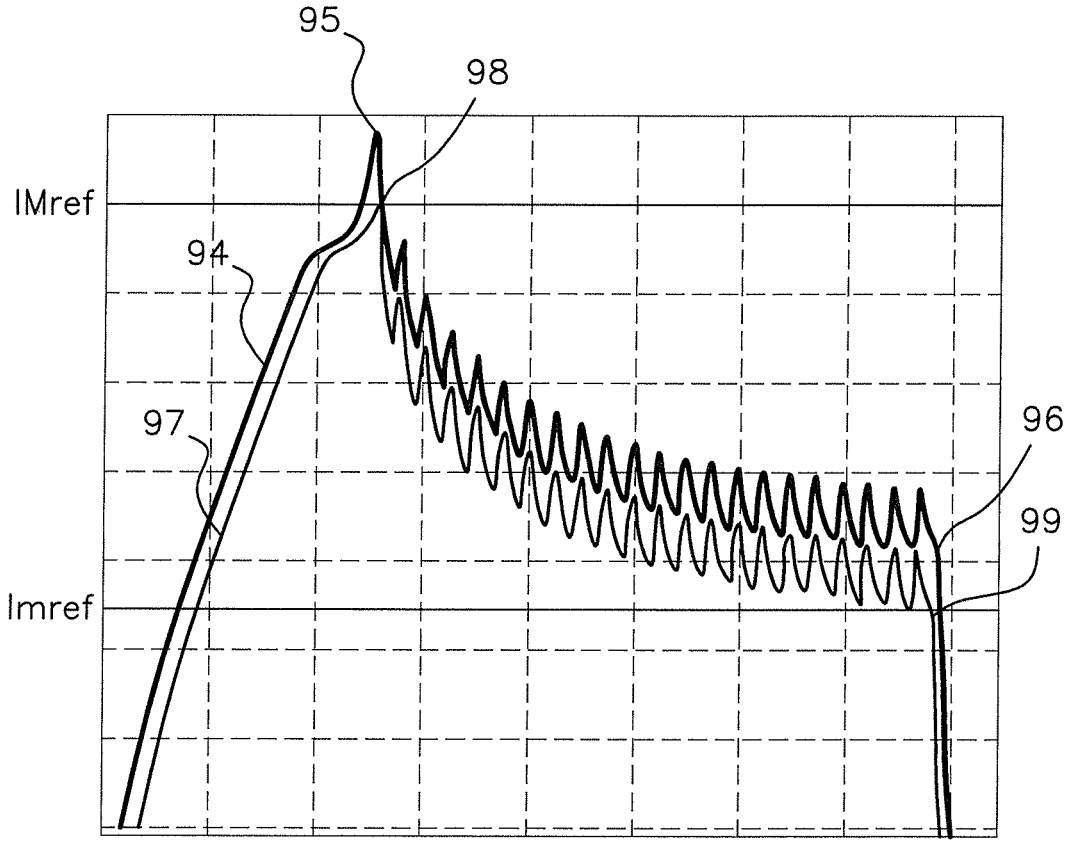
FIG. 12 illustrates the improvement provided by the invention.

FIG. 12 shows the current curve from FIG. 8 before and after adaptation of the two variables, in order to show the improvement made by the invention. The curve 94 is the curve before adaptation. It can be seen that the peak current value IM, 95 is clearly higher than the reference value IMref. Likewise the holding current value Im, 96 is much higher than the reference value Imref. The curve 97 is the curve after adaptation. It can be seen that the peak current value IM, 98 is now substantially equal to the reference value IMref. Likewise the holding current value Im, 99 is now substantially equal to the reference value Imref.

The invention claimed is:

1. A direct fuel injection system including a common rail (4) including a control unit (1), a pump (2) and a valve (3), controlled on an on-or-off basis by the control unit (1), in order to regulate the volume of fuel sent to the pump (2) to be fed into the common rail (4), said control unit (1) comprising:

first determination means (40) that determines a peak phase duration (27) during which a first command must be applied to the valve (3), and thereby obtains a peak current (38, 60) greater than or equal to a reference peak current (61) necessary to cause a change of state of the valve (3);

second determination means (70) that determines a holding ratio (28) in accordance with which a second command must be applied to the valve (3), after a change of state of the valve, thereby maintaining a holding current (39, 90) greater than or equal to a reference holding current (91) necessary to maintain said state of the valve (3);

application means that applies said first command to said valve (3) continuously during said peak phase duration (27), and then said second command by pulse width modulation in accordance with said holding ratio (28); and adaptation means (42, 72) that corrects any of the peak phase duration (27) and the holding ratio (28) in a recurrent and automatic manner, wherein said adaptation means (42, 72) calculate a coefficient of modulation (43, 73) and apply the calculated coefficient of modulation as a multiplier to any of the peak phase duration (27) and the holding ratio (28) to generate one of a corrected peak phase duration and a corrected holding ratio.

2. The system as claimed in claim 1, wherein said adaptation means (42, 72) further include calculation means (44, 74) adapted to calculate said coefficient of modulation (43, 73) in a recurrent manner as a function of a preceding value of said coefficient of modulation (63, 93) and a difference between one of the peak current (38, 60) and the holding current (39, 90), and a corresponding one of the reference peak current (61) and the reference holding current (91).

3. The system as claimed in claim 2, wherein said calculation means (44, 74) are adapted to apply the formula:

$$CM(n) = CM(n-1) + G \cdot \frac{Vref(n) - V(n)}{Vref(n)}$$

in which

CM(n) is the coefficient of modulation (43, 73) at the time n,

CM(n−1) is the coefficient of modulation (63, 93) at the preceding time n−1, G is a gain (62, 92), V(n) is one of the peak current (38, 60) and the holding current (39, 90) at the time n, and Vref(n) is one of the reference peak current (61) and the reference holding current (91) corresponding to at the time n.

4. The system as claimed in claim 2, wherein the calculation means (44, 74) recalculate the coefficient of modulation (43, 73) periodically.

5. The system as claimed in claim 2, wherein the calculation means (44, 74) recalculate the coefficient of modulation (43, 73) if any of the peak current (38, 60) and the holding current (39, 90) departs from a predefined range.

6. The system as claimed in claim 3, wherein the calculation means (44, 74) recalculate the coefficient of modulation (43, 73) periodically.

7. The system as claimed in claim 3, wherein the calculation means (44, 74) recalculate the coefficient of modulation (43, 73) if V(n) departs from a predefined range.

8. The system as claimed in claim 4, wherein the calculation means (44, 74) recalculate the coefficient of modulation (43, 73) if any of the peak current (38, 60) and the holding current (39, 90) departs from a predefined range.

9. A direct fuel injection system, comprising:

a common rail (4);

a control unit (1);

a pump (2); and a valve (3), controlled on an on-or-off basis by the control unit (1) to regulate a volume of fuel sent to the pump (2) to be fed into the common rail (4), wherein said control unit (1) comprises:

a first determiner means (40) that determines a peak phase duration (27) during which a first command must be applied to the valve (3), and thereby obtains a peak phase duration (27) greater than or equal to a reference peak current (61) necessary to cause a change of state of the valve (3);

a second determiner means (70) that determines a holding ratio (28) in accordance with which a second command must be applied to the valve (3), after a change of state of the valve, thereby maintaining a holding current (39, 90) greater than or equal to a reference holding current (91) necessary to maintain said state of the valve (3);

an applicator that applies said first command to said valve (3) continuously during said peak peak phase duration, and then said second command by pulse width modulation in accordance with said holding ratio (28); and an adapter (42, 72) that corrects any of the peak phase duration (27) and the holding ratio (28) in a recurrent and automatic manner, and wherein said adapter (42, 72) calculate a coefficient of modulation (43, 73) and apply the calculated coefficient of modulation as a multiplier to any of the peak phase duration (27) and the holding ratio (28) to generate one of a corrected peak phase duration and a corrected holding ratio.

10. A method for controlling a direct fuel injection system that includes a common rail (4) with a control unit (1), a pump (2) and a valve (3), controlled on an on-or-off basis by the control unit (1), in order to regulate the volume of fuel sent to the pump (2) to be fed into the common rail (4), comprising:

determining a peak phase duration (27) during which a first command must be applied to the valve (3), and thereby obtains a peak current (38, 60) greater than or equal to a reference peak current (61) necessary to cause a change of state of the valve (3);

determining a holding ratio (28) in accordance with which a second command must be applied to the valve (3), after a change of state of the valve, thereby maintaining a holding current (39, 90) greater than or equal to a reference holding current (91) necessary to maintain said state of the valve (3);

applying said first command to said valve (3) continuously during said peak phase duration (27), and then said second command by pulse width modulation in accordance with said holding ratio (28); and correcting any of the peak phase duration (27) and the holding ratio (28) in a recurrent and automatic manner, wherein said correction step includes calculating a coefficient of modulation (43, 73) and applying the calculated coefficient of modulation as a multiplier to any of the peak phase duration (27) and the holding ratio (28) to generate one of a corrected peak phase duration and a corrected holding ratio.

* * * * *